US006803725B2

(12) United States Patent
Jin

(10) Patent No.: US 6,803,725 B2
(45) Date of Patent: Oct. 12, 2004

(54) ON-CHIP VACUUM MICROTUBE DEVICE AND METHOD FOR MAKING SUCH DEVICE

(75) Inventor: Sungho Jin, San Diego, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 10/646,600

(22) Filed: Aug. 23, 2003

(65) Prior Publication Data

US 2004/0108550 A1 Jun. 10, 2004

Related U.S. Application Data

(60) Provisional application No. 60/405,560, filed on Aug. 23, 2002.

(51) Int. Cl.[7] ..... H01J 23/04

(52) U.S. Cl. ..... 315/3.5; 313/293; 313/309; 313/311; 313/495; 315/5.18; 315/5.19

(58) Field of Search ..... 313/293, 309, 313/311, 495; 315/3.5, 5.18, 5.19

(56) References Cited

U.S. PATENT DOCUMENTS 6,283,812 B1 * 9/2001 Jin et al. ..... 445/24
6,297,592 B1 * 10/2001 Goren et al. ..... 315/3.5
6,538,367 B1 * 3/2003 Choi et al. ..... 313/309

FOREIGN PATENT DOCUMENTS

EP 1 184 888 * 3/2002 ..... H01J/21/10

* cited by examiner

*Primary Examiner*—David Nelms
*Assistant Examiner*—Dao H. Nguyen
(74) *Attorney, Agent, or Firm*—Lowenstein Sandler PC

(57) ABSTRACT

In accordance with the invention, improved vacuum microtube devices are provided with arrangements for tunably spacing the gate and the cathode. Tuning can be effected by using an electrostaic or magnetic actuator to move the gate on a spring or a rail. Advantageously a feedback arrangement can be used to control the spacing. Magnetic reassembly components can be provided for facilitating release of tube components in fabrication.

9 Claims, 4 Drawing Sheets

ON-CHIP VACUUM MICROTUBE DEVICE AND METHOD FOR MAKING SUCH DEVICE

CROSS REFERENCE TO RELATED APPLICATIONS

This application claims the benefit of U.S. Provisional Application Serial No. 60/405,560 filed by Sungho Jin on Aug. 23, 2002, which application is incorporated herein by reference.

FIELD OF THE INVENTION

The invention relates to microwave vacuum tube devices and, in particular, to microscale vacuum tubes (microtubes).

BACKGROUND OF THE INVENTION

The modem communications industry began with the development of gridded vacuum tube amplifiers. Microwave vacuum tube devices, such as power amplifiers, are essential components of microwave systems including telecommunications, radar, electronic warfare and navigation systems. While semiconductor microwave amplifiers are available, they lack the power capabilities required by most microwave systems. Vacuum tube amplifiers, in contrast, can provide microwave power which is higher by orders of magnitude. The higher power levels are because electrons can travel faster in vacuum with fewer collisions than in semiconductor material. The higher speeds permit larger structures with the same transit time which, in turn, produce greater power output.

In a typical microwave tube device an input signal interacts with a beam of electrons. The output signal is derived from the thus-modulated beam. See, e.g., A. S. Gilmour, Jr., *Microwave Tubes*, Artech House, 1986, 191–313. Microwave tube devices include gridded tubes (e.g., triodes, tetrodes, pentodes, and klystrodes), klystrons, traveling wave tubes, crossed-field amplifiers and gyrotrons. All contain a cathode structure including a source of electrons for the beam (cathode), an interaction structure (grid or gate), and an output structure (anode). The grid is used to induce or modulate the beam.

Conventional vacuum tube devices are typically fabricated by mechanical assembly of the individual components. The components are made separately and then they are secured on a supporting structure. Unfortunately, such assembly is not efficient or cost-effective, and it inevitably introduces some misalignment and asymmetry into the device. Some attempts to address these problems have led to use of sacrificial layers in a rigid structure, i.e., a structure is rigidly built with layers or regions that are removed in order to expose or free the components of the device. See, e.g., U.S. Pat. No. 5,637,539 and I. Brodie and C. Spindt, "Vacuum microelectronics," *Advances in Electronics and Electron Physics*, Vol. 83 (1992). These rigid structures present improvements, but still encounter formidable fabrication problems.

The usual source of beam electrons is a thermionic emission cathode. The emission cathode is typically formed from tungsten that is either coated with barium or barium oxide, or mixed with thorium oxide. Thermionic emission cathodes must be heated to temperatures around 1000 degrees C. to produce sufficient thermionic electron emission current, e.g., on the order of amperes per square centimeter. The necessity of heating thermionic cathodes to such high temperatures creates several problems. For example, the heating limits the lifetime of the cathodes, introduces warm-up delays, requires bulky auxiliary equipment for cooling, and tends to interfere with high-speed modulation of emission in gridded tubes.

While transistors have been miniaturized to micron scale dimensions, it has been much more difficult to miniaturize reliable vacuum tube devices. This difficulty arises in part because the conventional approach to fabricating vacuum tubes becomes increasingly difficult as component size is reduced. The difficulties are further aggravated because the high temperature thermionic emission cathodes used with conventional vacuum tubes present increasingly serious heat and reliability problems in miniaturized tubes.

A promising new approach to microminiaturizing vacuum tubes is the use of surface micromachining to make microscale triode arrays using cold cathode emitters such as carbon nanotubes. See Bower et al., *Applied Physics Letters*, Vol. 80, p. 3820 (May 20, 2002). This approach forms tiny hinged cathode, grid and anode structures on a substrate surface and then releases them from the surface to lock into proper positions for a triode.

FIGS. 1A and 1B illustrate the formation of a triode microtube using this approach. FIG. 1(*a*) shows the microtube components formed on a substrate 1 before release. The components include surface precursors for a cathode 2, a gate 3 and an anode 4, all releasably hinged to the substrate 1. The cathode 2 can comprise carbon nanotube emitters 5 grown on a region of polysilicon. The gate 3 can be a region of polysilicon provided with apertures 6, and the anode 4 can be a third region of polysilicon. The polysilicon regions can be lithographically patterned in a polysilicon film disposed on a silicon substrate. The carbon nanotubes can be grown from patterned catalyst islands in accordance with techniques well known in the art. The high aspect ratio of the nanotubes (>1000) and their small tip radii of curvature (~1 to 30 nm), coupled with their high mechanical strength and chemical stability, make them particularly attractive as electron emitters. FIG. 1B shows the components after the release step which is typically manual. Release aligns the gate 3 between the cathode 2 and the anode 4 in triode configuration.

The term "flexural member" includes any structure that induces or allows movement of a structural region into its desired configuration in the device. "Pop-up" indicates that the structural region is induced to move upon release, without the need for external force. "Hinge mechanism" indicates one or more flexural members, e.g., a hinge, that allows the component to be moved, e.g., rotated, by applying external force. The cathode structure contains a cathode and one or more grids. The input structure is where the microwave signal to be amplified is introduced (in some configurations, the input structure is a grid of the cathode structure). The interaction structure is where the electron beam interacts with the microwave signal to be amplified. The output structure is where the amplified microwave power is removed, and the collection structure is where the electron beam is collected after the amplified microwave power has been removed.

FIG. 2, which is useful in illustrating a problem to which the present invention is directed, is a scanning electron microphoto which shows an exemplary surface micromachined triode device. On the surface of the device substrate 10, e.g., a silicon nitride surface on a silicon wafer, are formed a cathode electrode 12 attached to the device substrate 10 surface by a hinge mechanism 13 and a spring 11, a grid 14 attached to the device substrate 10 surface by a hinge mechanism 15, and an anode 16 attached to the device substrate 10 by a hinge mechanism 17. Also on the substrate 10 surface are contacts 18 electrically connected to the cathode electrode 12, grid 14, and anode 16. The contacts 18 and connective wiring are typically polysilicon coated with gold, although other materials are possible. Design of the connective wiring should take into account the subsequent rotation of the cathode electrode 12, grid 14, and anode 16, to avoid breakage and/or reliability problems. The substrate 10 also has three locking mechanisms 24, 26, 28, which secure the cathode 12, grid 14, and anode 16 in an upright position, as discussed below. All these components, including the hinges, are formed by a surface micromachining process. The inset is a magnified view of the aligned and patterned carbon nanotubes 19 (deposited on the cathode 12), placed against the MEMS gate electrode (grid 14).

The cathode electrode 12, with attached emitters 19, the grid 14, and the anode 16, are surface micromachined and then mechanically rotated on their hinges, 13, 15, 17 and brought to an upright position—substantially perpendicular to the surface of the device substrate 10. The locking mechanisms 24, 26, 28 are then rotated on their hinges to secure the cathode electrode 12, grid 14, and anode 16 in these upright positions.

In the structure of FIG. 2, the cathode electrode, the grid, and the anode are arranged such that their surfaces are substantially parallel to each other, and substantially perpendicular to the substrate. Vacuum sealing and packaging of the structure are then effected by conventional techniques.

In operation, a weak microwave signal to be amplified is applied between the grid and the cathode. The signal applied to the grid controls the number of electrons drawn from the cathode. During the positive half of the microwave cycle, more electrons are drawn. During the negative half, fewer electrons are drawn. This modulated beam of electrons passes through the grid and goes to the anode. A small voltage on the grid controls a large amount of current. As this current passes through an external load, it produces a large voltage, and the gridded tube thereby provides gain. Because the spacing between the grid and the cathode can be very small, a microtube triode (or other gridded microtube) can potentially operate at very high frequencies on the order of 1 GHz or more.

The term "microtube" as used herein refers to a silicon chip supported vacuum tube amplifier for high frequency RF or microwave power wherein the cathode-grid distance is less than about 100 micrometers and preferably less than 20 micrometers. The cathode-anode distance is typical less than 2000 micrometers and preferably less than 2000 micrometers and preferably less than 500 micrometers. The active area of each cathode in a cathode array is typically less than one square micrometer and preferably less than 0.1 square micrometer. The term covers all gridded microtubes including silicon chip supported triodes, tetrodes, pentodes and klystrodes.

While microtube device function has been demonstrated, the field emission efficiency needs further improvements. The intensity and performance of electron field emission are strongly dependent on the electric field applied between the cathode and the gate (grid) and the field between the cathode and the anode. The cathode-gate gap spacing needs to be controlled to a few micrometers. The manual flip-up of the micromachined electrodes into the desired vertical position fails to provide consistent control of the cathode-gate gap spacing, especially if there are inhomogeneities in the height of the nanotube emitters. Accordingly there is a need for improved microtube devices having more precisely controlled electrode spacing and for improved methods for making such devices.

SUMMARY OF THE INVENTION

In accordance with the invention, improved vacuum microtube devices are provided with arrangements for tunably spacing the gate and the cathode. Tuning can be effected by using an electrostatic or magnetic actuator to move the gate on a spring or a rail. Advantageously a feedback arrangement can be used to control the spacing. Magnetic reassembly components can be provided for facilitating release of tube components in fabrication.

BRIEF DESCRIPTION OF THE DRAWINGS

The nature, advantages and various additional features of the invention will appear more fully upon consideration of the illustrative embodiments now to be described in detail with the accompanying drawings. In the drawings.

It is to be understood that the drawings are for purposes of illustrating the concepts of the invention and are not to scale.

DETAILED DESCRIPTION OF THE INVENTION

Figure 3A:
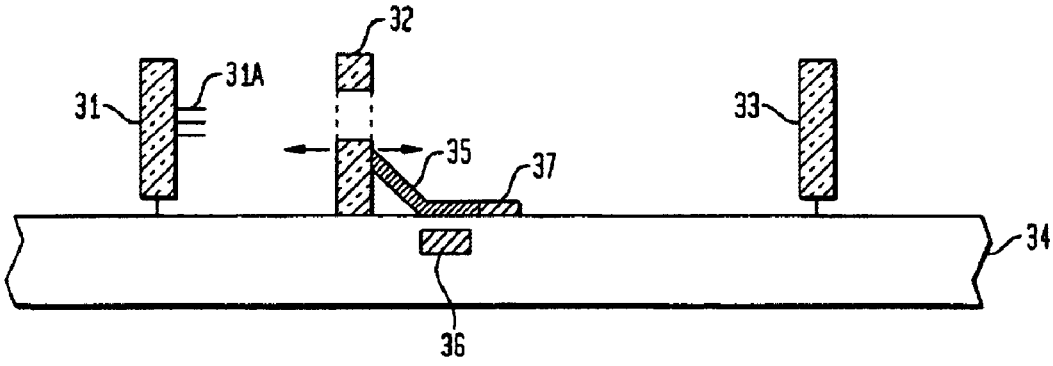
FIGS. 3(*a*) and (*b*) schematically illustrate improved MEMS-based vacuum microtube devices according to the invention.
Figure 3B:
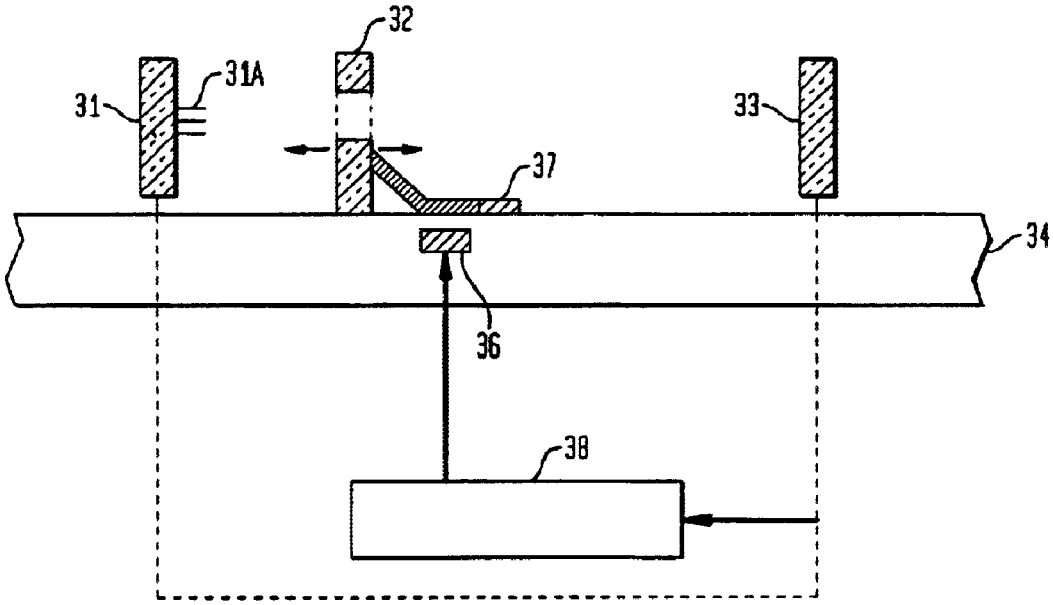

Referring again to the drawings, FIG. 3(*a*) schematically illustrates a vacuum microtube 30 in accordance with the invention. The microtube 30 comprises cathode 31, an adjustable microscale gate electrode (or grid) 32 and a microscale anode 33, all supported on a substrate 34. The cathode 31 includes an array of nanotube electron emitters 31A. The gate electrode 32 (or alternatively, the cathode electrode 31) has additional flexural members 35 attached to it, which support the electrode yet are movable. For example, the lateral movement of the gate 32 can be accomplished by sliding on a rail member or by stretching/compressing a spring member. In the exemplary embodiment as illustrated in FIG. 3(*a*), an electrostatic actuator such as a scratch drive actuator electrode 36 is incorporated for lateral movement of a gate electrode 37 to provide any needed adjustment of the cathode-gate gap spacing. Alternatively, the gate structure 32 can include a magnetic element and a magnetic actuator can be used to adjust the gate/cathode spacing. Instead of lateral movement, tilting of the gate toward or away from the cathode may also be used to control the electric field between the electrodes, as long as slightly non-parallel electrodes are acceptable. The desired magnitude of the lateral movement of the gate is in the range of 0.01–50 micrometers, preferably in the range of 0.1–10 micrometers. In this gap-tunable MEMS vacuum microtube, the desired range of variation of emission current values among the various cold cathodes located on the same Si wafer or chip unit is less than 20%, preferably less than 10%. The microtube device illustrated in FIGS. 3(*a*) and 3(*b*) can be fabricated using the surface micromachining process described above and in greater detail in the attached Appendix A.

As illustrated in FIG. 3(*b*), the emission current obtained in the vacuum microtube device can be sent, via an automatic feedback system to a MEMS controller 38 for control of the lateral gate movement. This enables an automatic self compensation of cathode-grid spacing to provide a uniformity of field emission among many cold cathode devices in an array, as well as to provide time-independent emission performance. Thus nonuniformities in nanotube emitter characteristics can be automatically compensated. For example, in case the cathode-gate gap distance inadvertantly increases over years by consumption of nanotube material during repeated/prolonged operation of the cold cathode, the gap will thus adjust to ensure a consistency of power amplifier performance. The closeness of the gate to the cathode also dictates and enhances the high frequency modulation behavior in terms of producing giga Hz level amplified signals for communications applications. The desirable level of uniformity in amplifier performance is in the range of less than 20%, preferably less than 10% variation in amplification factor among the various devices on the same wafer.

Figure 4A:
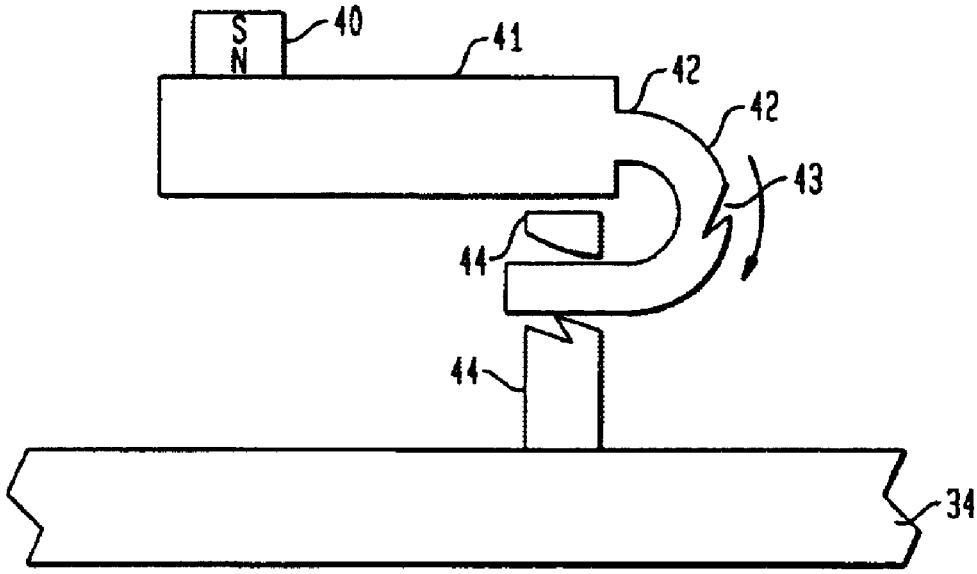
FIGS. 4(*a*) and (*b*) schematically illustrate devices having magnetic reassembly components and their use in fabricating microtubes.
Figure 4B:
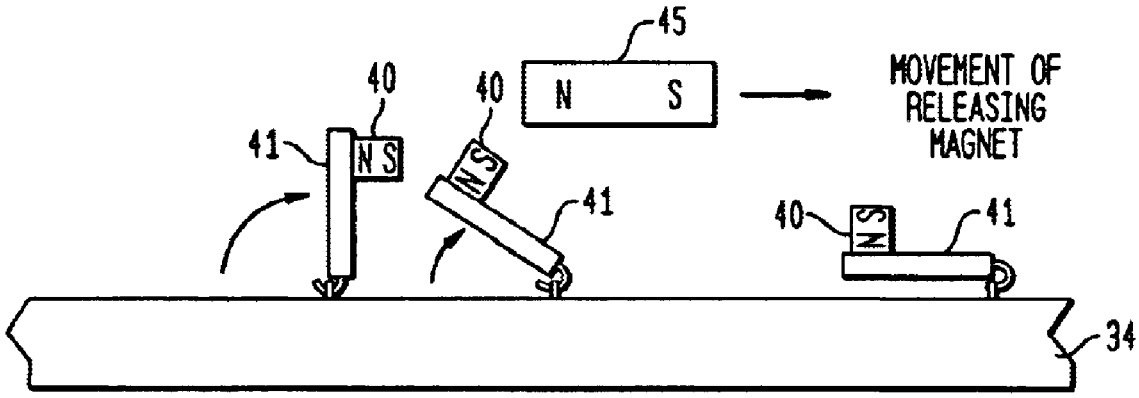

A manual release of flexured members is not amenable to industrial manufacturing process. Thus it would be desirable to have an industrially acceptable fabrication process which allows the flip-up and reassembly of the MEMS components in a global manner on all the MEMS devices in the array, instead of manual flip-up of one device at a time. Another aspect of the invention is that by optionally pre-depositing or attaching magnetic components onto the flexural components, flexural members can be released or rearranged by applying a globally sweeping, magnetic field movement along the in-plane direction. This method is schematically illustrated in FIG. 4(*a*). A magnetic component 40 is attached to an electrode flexural member 41 having a rotatable part 42 and at least one notch 43 which can click into the catch post 44 permanently once the rotation reaches a certain angle. The in-plane movement of magnetic field, such as obtained by a lateral movement of a permanent magnet 45 or by a sequential activation of an array of electromagnets, conveniently raises all the flexural members to the desired vertical position. As can readily be seen, the three components 41 in FIG. 4(*b*) could be the cathode, gate and anode of a microtube, and they could be globally released by magnet 45.

The conventional portions of the device of FIGS. 3 and 4 can be readily fabricated by the surface micromachining process described in Appendix A. In essence, the microtube components—cathode, emitter, gate anode and flexural members, along with numerous sacrificial regions—are formed on the surface of a substrate. They are then released and moved into operative position.

The fabrication process involves providing numerous structural regions that constitute the elements of the ultimate device, and numerous sacrificial regions. The structure is subjected to a treatment, e.g., an etch, to remove the sacrificial regions—referred to as a release step. One or more of the structural regions have flexural members that provide for movement of the regions upon such release. Specifically, the released structural regions having these flexural members either move into place themselves, as in a pop-up design, or, alternatively, can be physically moved into place, as by rotation around a flexural hinge mechanism. This movement puts the elements of the device into the appropriate configuration. All the components of the microtube device are capable of having such flexural members, including, e.g., a cathode structure, an input structure, an interaction structure, an output structure and/or a collection structure. And it is therefore possible for all the components of the device to be arranged using such flexural members, or some combination of structural regions with and without such members.

For electron field emission, a variety of cold cathode emitter materials can be used, including carbon nanotubes, diamond, and amorphous carbon. Carbon nanotubes are particularly attractive as field emitters because their high aspect ratio (>1,000), one-dimensional structure, and small tip radii of curvature (~10 nm) tend to effectively concentrate the electric field. In addition, the atomic arrangement in a nanotube structure imparts superior mechanical strength and chemical stability, both of which make nanotube field emitters robust and stable. It is possible to prepare carbon nanotubes by a variety of techniques, including carbon-arc discharge, chemical vapor deposition via catalytic pyrolysis of hydrocarbons, laser ablation of a catalytic metal-containing graphite target, or condensed-phase electrolysis. Depending on the method of preparation and the specific process parameters, the nanotubes are produced multi-walled, single-walled, or as bundles of single-walled tubules, and can adopt various shapes such as straight, curved, planar-spiral and helix. Carbon nanotubes are typically grown in the form of randomly oriented, needle-like or spaghetti-like mats. However, oriented nanotube structures are also possible, as reflected in Ren et al., *Science*, Vol. 282, 1105, (1998); Fan et al., *Science*, Vol. 283, 512 (1999).

Carbon nanotube emitters are discussed, for example, in Rinzler et al., *Science*, Vol. 269, 1550 (1995); De Heer et al., *Science*, Vol. 270, 1179 (1995); Saito et al., *Jpn. J. Appl. Phys.*, Vol. 37, L346 (1998); Wang et al., *Appl. Phys. Lett.*, Vol. 70, 3308, (1997); Saito et al., *Jpn. J. Appl. Phys.*, Vol. 36, L1340 (1997); Wang et al., *Appl. Phys. Lett.*, Vol. 72, 2912 (1998); and Bonard et al., *Appl. Phys. Lett.*, Vol. 73, 918 (1998).

As reflected in these techniques, it is possible to form carbon nanotube emitters on a substrate by either in-situ growth or post-deposition spraying techniques. For in-situ growth in the invention, the device substrate, with mask in place over the components other than the cathode electrode surface, is generally placed in a chemical vapor deposition chamber, and pre-coated with a thin layer (e.g., 1–20 nm thick) of catalyst metal such as Co, Ni or Fe (or formed from such a metal). The gas chemistry is typically hydrocarbon or carbon dioxide mixed with hydrogen or ammonia. Depending on specific process conditions, it is possible to grow the nanotubes in either an aligned or random manner. Optionally, a plasma enhanced chemical vapor deposition technique is used to grow highly aligned nanotubes on the substrate surface.

In a typical post-deposition technique, pre-formed and purified nanotube powders are mixed with solvents and optionally binders (which are pyrolized later) to form a solution or slurry. The mixture is then disposed, e.g., dispersed by spray, onto the masked device substrate in which the cathode electrode surface is exposed. The cathode electrode optionally is provided with a layer of a carbon dissolving element (e.g., Ni, Fe, Co) or a carbide forming element (e.g., Si, Mo, Ti, Ta, Cr), to form a desired emitter structure. Annealing in either air, vacuum or inert atmosphere is followed to drive out the solvent, leaving a nanotube emitter structure on the substrate. And where the carbon dissolving or carbide forming elements are present, annealing promotes improved adhesion. Other post-deposition techniques are also possible.

The diameter of the field-emitting nanotubes is typically about 1 to 300 nm. The length of the nanotubes is typically about 0.05 to 100 $\mu$m. To maintain the small gap between the cathode and the grid, and thereby achieve a reduced transit time and a higher operating frequency, the nanotubes advantageously exhibit a relatively uniform height, e.g., at least 90% of the nanotubes have a height that varies no more than 20% from the average height.

Because of the nanometer scale of the nanotubes, the nanotube emitters provide many potential emitting points, typically more than $10^9$ emitting tips per square centimeter assuming a 10% area coverage and 10% activated emitters from 30 nm (in diameter) sized nanotubes. The emitter site density in the invention is typically at least $10^3/cm^2$, advantageously at least $10^4/cm^2$ and more advantageously at least $10^5/cm^2$. The nanotube-containing cathode requires a turn-on field of less than 2 V/$\mu$m to generate 1 nA of emission current, and exhibits an emission current density of at least 0.1 $A/cm^2$, advantageously at least 0.5 $A/cm^2$, at an electric field of 5 to 50 V/$\mu$m.

Figure 2:
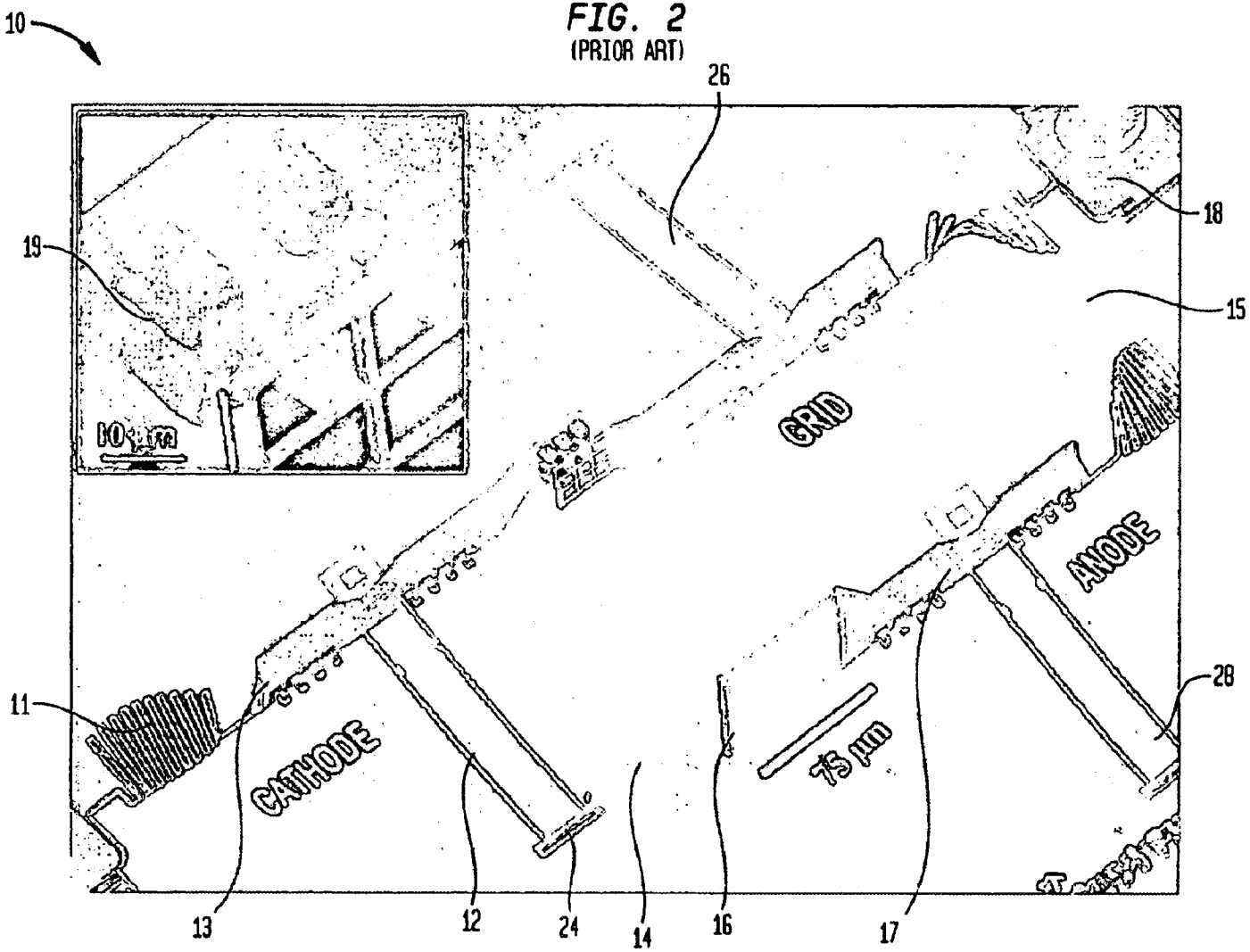
FIG. 2 (PRIOR ART)
FIG. 2, which is prior art, is a photograph of a MEMS-based vacuum microtube device constructed using surface micromachining.

Nanotube emitters are formed on the cathode electrode, for example, by a microwave plasma enhanced chemical vapor deposition technique. After a mask is placed over the device substrate—leaving the cathode electrode surface exposed, a thin layer, e.g., a few nanometer thick, nucleation layer of Co, Fe, or Ni can be sputter-deposited through the opening onto the cathode electrode. This layer serves as catalyst for nanotube nucleation. The structure is then transferred in air to a microwave plasma enhanced chemical vapor deposition (MPECVD) system to start the nanotube growth. A typical CVD deposition of nanotube can be carried out at a temperature of 700–100° C. in flowing hydrogen in 2–100 minutes. A microwave plasma of ammonia ($NH_3$) and 10 to 30 vol. % acetylene ($C_2H_2$) can be used for the nanotube growth. As shown in FIG. 2, the nanotubes grown under these conditions are aligned. Because the nanotube growth is highly selective, with growth occurring only in areas where cobalt is present, the nanotubes are substantially confined on the cathode in an area defined by the opening in the mask through which cobalt is deposited.

In summary, it can now be seen that the invention concerns improvements in vacuum microtube devices comprising a silicon substrate, a cathode comprising electron emitters secured to the substrate, an anode secured to the substrate and a gate between the cathode and the anode secured to the substrate to induce electron emission from the cathode to the anode. In one improved device, the spacing between the gate and the cathode is tunable. In one advantageous embodiment the gate is secured to the substrate by a resilient element and the spacing between the gate and the cathode is tunable by stretching or compressing the resilient element. The stretching or compressing can advantageously be effected by an electrostatic actuator secured to the substrate.

In another advantageous embodiment, the gate is secured to the substrate by a rail member and the spacing between the gate and the cathode is tunable by sliding the grid on the rail member. An electrostatic actuator can slide the gate on the rail.

The microtube device with tunable spacing can further comprise a feedback circuit responsive to the current received by the anode. An actuator, responsive to the feedback circuit, can tune the spacing between the gate and the cathode in accordance with the feedback signal.

Another improvement relates to the fabrication of a vacuum microtube device comprising a silicon substrate, a cathode comprising electron emitters recured to the substrate, and a gate between the cathode and the anode secured to the substrate. Where at least one of the cathode, anode or gate are attached to the substrate by a flexural member for changing the position of the cathode, anode or gate, the process can be improved by adding a magnetic component to the flexural component for permitting change of position by an external magnetic field. Advantageously, a locking arrangement can be provided for locking the cathode, anode or gate in position when the flexural member flexes by a sufficient amount. The above improvements are particularly useful for changing positions of components in an array of microtubes on a substrate.

It is understood that the above-described embodiments are illustrative of only a few of the many possible specific embodiments which can represent applications of the invention. For example, while the invention has been illustrated as a microscale triode, it is equally applicable to the other vacuum including tetrodes, pentodes and klystrodes. Numerous and varied other arrangements can be made by those skilled in the art without departing from the spirit and scope of the invention.

Appendix A

Figure 1A:
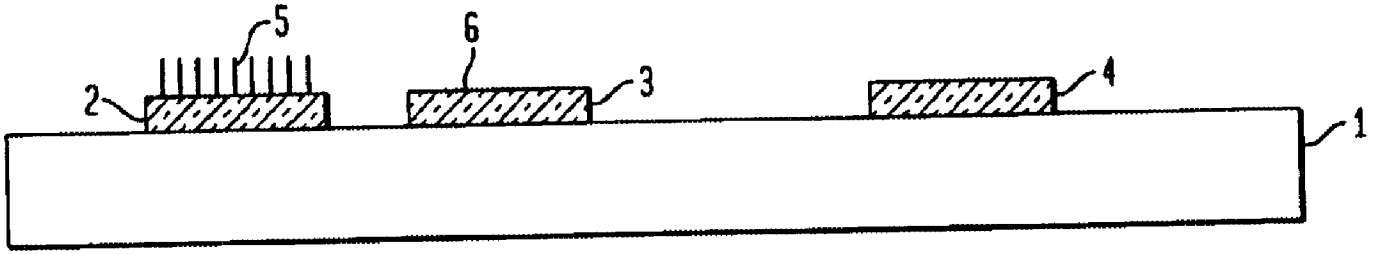
FIG. 1A (PRIOR ART)
FIGS. 1(*a*) and (*b*), which are prior art, illustrate a MEMS-based vacuum microtriode fabricated by surface micromachining.
Figure 1B:
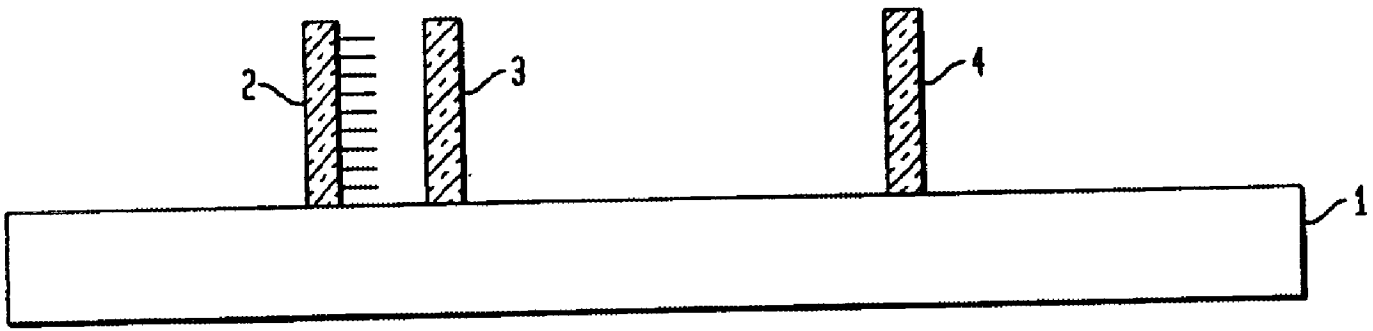
FIG. 1B (PRIOR ART)

To describe the process of fabricating the MEMS vacuum microtubes, the release step (meaning chemical etching to remove sacrificial spacer layers) of surface micromachined, multiplayer silicon-based structure provides a device substrate comprising a cathode electrode, a grid, and an anode, each being substantially planar with the device substrate surface and attached to the device substrate by a flexural member, e.g., a hinge mechanism. FIG. 1(*a*) schematically illustrates such a stage. A mask, such as a shadow mask, is placed over portions of the device substrate such that the cathode electrode surface is exposed while other components on the device substrate are covered, and electron emitters (such as carbon nanotubes, nanowires, sharp pointed cones, or negative-electron-affinity diamond islands or layers) are formed or deposited selectively on the exposed cathode electrode surface. The mask is then removed, and the cathode, grid, and anode are rotated around the flexural member toward a vertical position,, such that their surfaces are substantially parallel with each other, FIG. 1(*b*). (Removal of the mask includes complete detachment from the substrate, as well as simply rotating an attached mask away from the device components.)

The MEMS vacuum tube devices obtained by such a process are on a scale not typically attainable by conventional techniques. For example, in conventional gridded tubes the cathode electrode and grid typically have surfaces greater than $10^7$ $\mu m^2$, whereas according to the invention, it is possible to form a cathode electrode and grid having surfaces of $10^2$ to $10^6$ $\mu m^2$. Similarly, it is possible to attain extremely small cathode-grid spacings in the invention, e.g., as low as 3 $\mu$m, typically less than 50 $\mu$m, whereas current devices typically have a gap greater than 50 $\mu$m. Miniaturized devices of this size are not only useful for typical applications of microwave tubes, such as wireless base stations, but are also potentially useful in smaller-scale applications such as wireless handsets in mobile phones. While a particular anode configuration is reflected in the above embodiment, the formation techniques of the invention are applicable to a wide variety of gridded microwave tube types, including triodes, tetrodes, pentodes, and klystrodes, as well as other microwave tube devices having a variety of cathode, input, interaction, output, and collection structures. It is also possible to simultaneously form numerous devices on a single substrate, and to interconnect at least a portion of such devices to provide an integrated microwave circuit.

In one embodiment, a gridded microwave tube is formed as follows. The principles used in the fabrication are those applicable to a variety of microelectromechanical systems (MEMS). Detailed fabrication information is available from, for example, the Design Handbook of MUMPs (Multi-User MEMS Processes), a commercial program designed for general purpose micromachining, available from Cronos Integrated Microsystems, Research Triangle Park, North Carolina A 100 mm diameter, n-type, (100) oriented silicon wafer, with a resistivity of 1 to 2 ohm-cm is used as the initial substrate. The surface of the wafer is heavily doped with phosphorus in a standard diffusion furnace, using POCI as the dopant source. The dopant helps to reduce or prevent charge feed through to the substrate from electrostatic devices on the surface. Next, a 600 nm low-stress LPCVD (low pressure chemical vapor deposition) silicon nitride layer is deposited on the wafers as an electrical isolation layer. This is followed by the deposition of a 500 nm LPCVD polysilicon film—Poly 0. (It is also possible to use single crystal silicon, which provides increased thermal efficiency due to its higher thermal conductivity.) Poly 0 is then patterned by conventional photolithography, e.g., coating the wafers with photoresist, exposing the photoresist with the appropriate mask, and developing the exposed photoresist to create a pattern, and etching the pattern into the underlying layer using an RIE (Reactive Ion Etch) system.

A 2.0 $\mu$m phosphosilicate glass (PSG) sacrificial layer is then deposited by LPCVD and annealed at 1050° C. for 1 hour in argon. (Sacrificial indicates that the layer is not intended to be part of the final device structure, but is instead intended to be removed to leave the desired micromechanical structures. Materials other than PSG are possible.) This layer of PSG, known as First Oxide, is removed at the end of the process to free the first mechanical layer of polysilicon. The sacrificial layer is photolithographically patterned with a mask, e.g., a DIMPLES mask, as known in the art, and the pattern is then transferred into the sacrificial PSG layer by RIE. The nominal depth of the dimples is 750 nm.

The wafers are then lithographically patterned with a third mask layer—ANCHOR1. After etching ANCHOR1 to provide anchor holes to be filled by the first structural layer, that first structural layer of polysilicon (Poly 1) is deposited at a thickness of 2.0 $\mu$m, and fills the anchor holes. A 200 nm layer of PSG is deposited over the polysilicon and the wafer is annealed at 1050° C. for 1 hour. The anneal dopes the polysilicon with phosphorus from the PSG layers both above and below it. The anneal also serves to significantly reduce the net stress in the Poly 1 layer. The Poly 1 (and its PSG masking layer) is lithographically patterned using a mask designed to form the first structural layer POLY1. The PSG layer is etched to produce a hard mask for the subsequent polysilicon etch. The hard mask is more resistant to the polysilicon etch chemistry than the photoresist and ensures better transfer of the pattern into the polysilicon. After etching the polysilicon, the photoresist is stripped and the remaining oxide hard mask is removed by RIE.

After Poly 1 is etched, a second PSG layer (Second Oxide) is deposited and annealed. The Second Oxide is patterned using two different etch masks with different objectives. The POLY1_POLY2_VIA level provides for etch holes in the Second Oxide down to the Poly 1 layer. This provides a mechanical and electrical connection between the Poly 1 and Poly 2 layers. The POLY1_POLY2_VIA layer is lithographically patterned and etched by RIE. The ANCHOR2 level is provided to etch both the First and Second Oxide layers in one step, thereby eliminating any misalignment between separately etched holes. More importantly, the ANCHOR2 etch eliminates the need to make a cut in First Oxide unrelated to anchoring a Poly 1 structure. The ANCHOR2 layer is lithographically patterned and etched by RIE in the same way as POLY1_POLY2_VIA.

The second structural layer, Poly 2, is then deposited (1.5 $\mu$m thick) followed by the deposition of 200 $\mu$nm of PSG. As with Poly 1, the thin PSG layer acts as both an etch mask and dopant source for Poly 2. The wafer is annealed for one hour at 1050° C. to dope the polysilicon and reduce the residual film stress. The Poly 2 layer is lithographically patterned with a seventh mask (POLY2), and the PSG and polysilicon layers are etched by RIE using the same processing conditions as for Poly 1. The photoresist is then stripped and the masking oxide is removed.

The final deposited layer is a 0.5 $\mu$m metal layer that provides for probing, bonding, and/or electrical routing and connection. The wafer is patterned lithographically with the eighth mask (METAL) and the metal is deposited and patterned using lift-off to provide a desired metal pattern, e.g., metal conductors.

Once the structural fabrication is completed, the release of the sacrificial regions is preformed by immersing the chip in a bath of 49% HF (room temperature) for 1.5 to 2 minutes. This is followed by several minutes in DI water and then alcohol (to reduce stiction—i.e., the sticking of the structural members to the surrounding material) followed by at least 10 minutes in an oven at 150° C.

I claim:

1. In a vacuum microtube device comprising a silicon substrate, a cathode comprising electron emitters secured to the substrate, an anode secured to the substrate and a gate between the cathode and the anode secured to the substrate to induce electron emission from the cathode to the anode, wherein:

the spacing between the gate and the cathode is tunable.

2. The device of claim 1 wherein the gate is secured to the substrate by a resilient element and the spacing between the gate and the cathode is tunable by stretching or compressing the resilient element.

3. The device of claim 2 further comprising an electrostatic or magnetic actuator secured to the substrate for stretching or compressing the resilient element.

4. The device of claim 1 wherein the gate is secured to the substrate by a rail member and the spacing between the gate and the cathode is tunable by sliding the gate on the rail member.

5. The device of claim 4 further comprising an electrostatic or magnetic actuator secured to the substrate for sliding the gate on the rail member.

6. The device of claim 1 further comprising a feedback circuit responsive to the current received by the anode and an actuator, responsive to the feedback circuit, for tuning the spacing between the gate and the cathode.

7. The process of claim 1 wherein the substrate comprises a plurality of cathodes, anodes and gates as an array of microtubes.

8. In a process for fabricating a vacuum microtube device comprising a silicon substrate, a cathode including electron emitters attached to the substrate an anode attached to the substrate, and a gate secured to the substrate between the cathode and the anode, the process comprising the step of attaching at least one of the cathode, anode or gate to the substrate by a flexural member and stacking a magnetic component to the flexural member for changing the position of the cathode, anode or gate, respectively wherein:

the flexural member comprises a magnetic component for permitting change of position by an external magnetic field.

9. The process of claim 8 further comprising a locking arrangement for locking the cathode, anode or gate in position when the flexural member flexes by a sufficient amount.

* * * * *